US006650037B1

(12) United States Patent
Reed et al.

(10) Patent No.: US 6,650,037 B1
(45) Date of Patent: Nov. 18, 2003

(54) SHOCK ABSORBING STUD SHIM FOR A CRT

(75) Inventors: Joseph Arthur Reed, York, PA (US); Gary Lee Diven, Lancaster, PA (US); Louis Emmanuel Matalon, Lancaster, PA (US); Kelly Eugene Hamm, Holtwood, PA (US); Steven William Haun, Landisville, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 10/151,447

(22) Filed: May 20, 2002

(51) Int. Cl.[7] ..... H01J 29/07
(52) U.S. Cl. ..... 313/406; 313/404; 313/407
(58) Field of Search ..... 313/402, 404, 313/405, 406, 407, 269; H01J 29/07

(56) References Cited

U.S. PATENT DOCUMENTS

| | | | | | |
|---|---|---|---|---|---|
| 2,951,167 | A | | 8/1960 | Kegg et al. | 313/85 |
| 3,524,971 | A | * | 8/1970 | Schwartz et al. | 313/406 |
| 4,763,039 | A | | 8/1988 | Van Rens et al. | 313/406 |
| 4,798,992 | A | | 1/1989 | Ichigaya et al. | 313/406 |
| 4,987,337 | A | * | 1/1991 | Bongenaar et al. | 313/406 |
| 5,003,218 | A | * | 3/1991 | Gijrath et al. | 313/406 |
| 5,502,349 | A | * | 3/1996 | Seo | 313/404 |
| 6,469,430 | B1 | * | 10/2002 | Saita et al. | 313/404 |

* cited by examiner

*Primary Examiner*—Tho Phan
(74) *Attorney, Agent, or Firm*—Joseph S. Tripoli; Joseph J. Laks; Carlos M. Herrera

(57) ABSTRACT

The invention provides a CRT having a funnel sealed at one end to a faceplate panel with a luminescent screen on an interior surface thereof, a mask assembly supported within the CRT and in proximity to the screen, the faceplate panel having a plurality of peripheral sidewalls each having an inside surface. The CRT also includes a plurality of studs, with at least one stud affixed in each of the corners of inside surface of the sidewalls. A plurality of springs engage the corner studs, to support the mask assembly within the CRT; at least one additional stud is affixed along the inside surface of one sidewall and a shim is attached around the additional stud. On the mask assembly at least one bracket is positioned to have a slot into which the shim is loosely engaged, thereby mitigating motion in a plane parallel to the interior sidewall.

12 Claims, 3 Drawing Sheets

FIG. 1
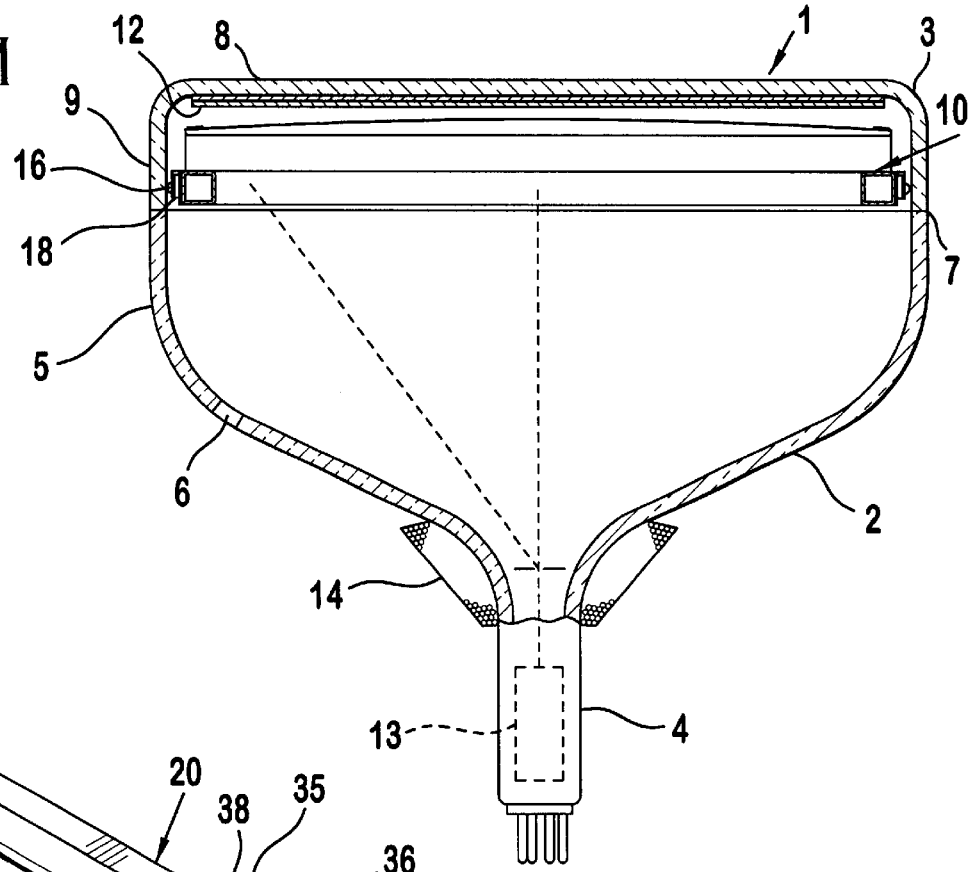
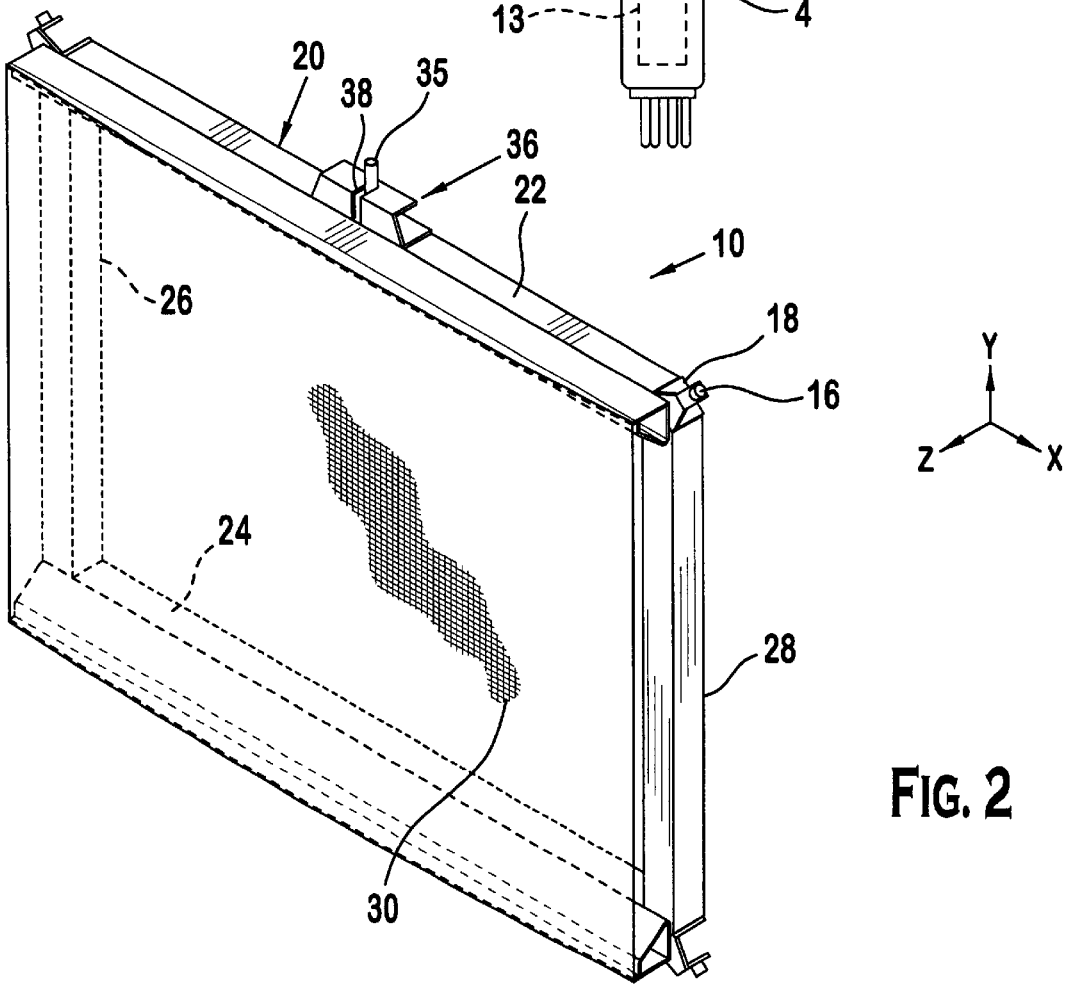
FIG. 2

SHOCK ABSORBING STUD SHIM FOR A CRT

FIELD OF THE INVENTION

This invention relates to a cathode ray tube having a shadow mask attached to a peripheral frame that is suspended in relation to a screen of the cathode ray tube and, particularly, to a support system for a mask-frame assembly in such a tube, which provides an improved shock handling capability.

BACKGROUND OF THE INVENTION

In most cathode ray tubes (CRT's), a peripheral frame, supporting a shadow mask, is suspended in a faceplate panel by means of springs that are welded either directly to the frame or to plates that in turn are welded to the frame. In large size tubes, it is common to use a mask-frame assembly support consisting of four springs to support a mask-frame assembly within a rectangular faceplate panel of a tube. In many recent tubes, the springs are located at the four corners of the frame to minimize twisting and shifting of the assembly within the panel. The mask-frame assembly supports are bent metal plates each of which are welded to the frame at one end and include an aperture at the other end. Each aperture engages a metal stud that is affixed in the faceplate panel sidewall.

The use of a corner support system for the support of a CRT tube shadow mask offers many advantages over an on-axis support system. However, the corner support system has the undesirable characteristic of asymmetric resistance to shock loads. CRT's employing corner support systems typically are less capable of sustaining shock loads in the horizontal (X) direction than in the vertical (Y) direction while returning the shadow mask to within a tolerable distance of its original position.

As usually mounted on a shadow mask frame, the corner support system springs are typically flexible in the radial direction and very stiff in the tangential direction. These springs are typically mounted at the mask diagonal corners. Because the mask diagonal does not lie at 45 degrees to the X and Y axes, for example, in a tube having a 4:3 or 16:9 (X to Y) aspect ratio, the resulting system stiffness in the X and Y directions are not equal. This inequality may result in an inadequate shock load capability and misalignment of the mask apertures with respect to their nominal positions, which, in turn, causes positional errors in the landings of the electron beams. Such mislandings are commonly referred to as misregistration, and, in operating tubes, the consequences of misregistration are white field nonuniformities and color purity errors. Hence, the need exists to reduce the propensity for such misregistration.

SUMMARY OF THE INVENTION

The invention provides a CRT having a funnel sealed at one end to a faceplate panel with a luminescent screen on an interior surface thereof, a mask assembly supported within the CRT and in proximity to the screen, the faceplate panel having a plurality of sidewalls each having an inside surface. The CRT also includes a plurality of a studs, with at least one stud affixed in each of the corners of the inside surface of the sidewalls. A plurality of springs engage the corner studs, to support the mask assembly within the CRT. At least one additional stud is affixed along the inside surface of one sidewall and a shim is attached around the additional stud.

On the mask assembly, at least one bracket is positioned to have a slot into which the shim is loosely engaged, thereby mitigating motion in a plane parallel to the interior sidewall.

BRIEF DESCRIPTION OF THE DRAWINGS

The invention will now be described by way of example with reference to the accompanying figures.

FIG. 1 is a cross sectional view of a CRT.

FIG. 2 is a perspective view of a mask frame assembly having the shock absorbing stud arrangement of the present invention.

DETAILED DESCRIPTION OF THE INVENTION

Figure 3:
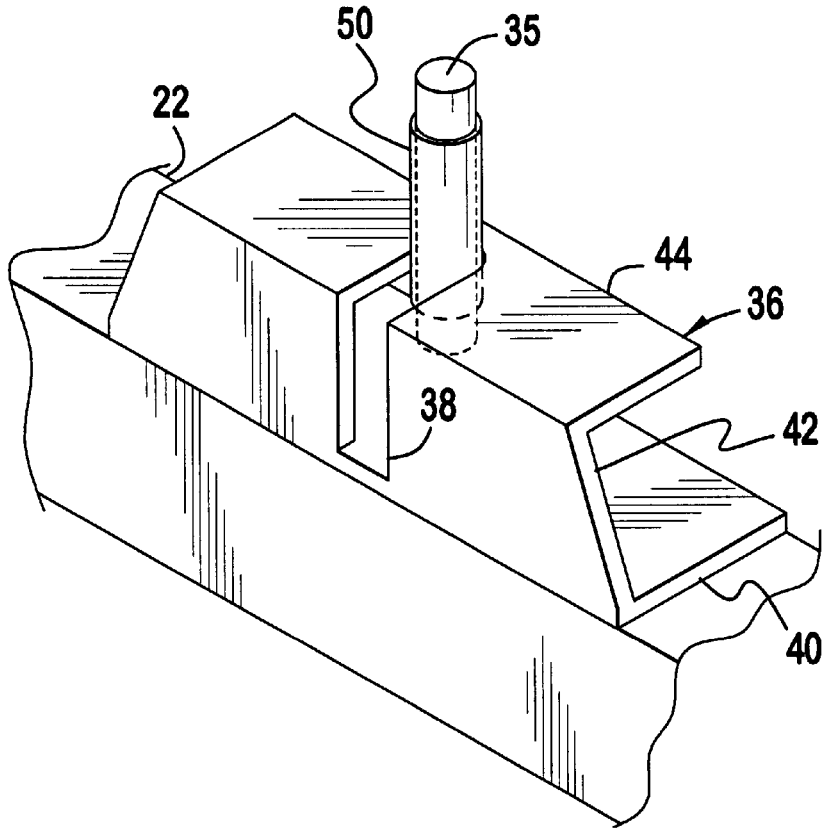
FIG. 3 is a partial perspective view of the shock absorbing stud arrangement of FIG. 2.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 has a viewing faceplate 8 and a peripheral flange or sidewall 9, which is sealed to the funnel 5 by a glass frit 7. A three-color phosphor screen 12 is carried by the inner surface of the faceplate panel 3. The screen 12 is a line screen with the phosphor lines arranged in triads, each of the triads including a phosphor line of each of the three colors. A mask support frame assembly 10 is removably mounted in predetermined spaced relation to the screen 12. An electron gun 13 (shown schematically by dashed lines in FIG. 1) is centrally mounted within the neck 4 to generate and direct three inline electron beams, a center beam and two side or outer beams, along convergent paths through the mask-frame assembly 10 to the screen 12. The CTR 1 of FIG. 1 is designed to be used with an external magnetic deflection yoke 14 located in the vicinity of the funnel-to-neck junction. When activated, the yoke 14 subjects the three electron beams to magnetic fields which cause the beams to scan horizontally and vertically in a rectangular raster over the screen 12.

The mask frame assembly 10, as shown in FIGS. 1 and 2, has a generally rectangular support frame 20 to which a peripheral portion of an apertured mask 30 is attached. The frame 20 includes two long sides 22, 24, and two short sides 26, 28. The two long sides 22, 24 of the frame 20 are parallel to a central major axis, X, of the CRT 1. The two short sides 26, 28 are parallel to a central minor axis, Y, of the CRT 1. The two long sides 22, 24 and two short sides 26, 28 form a continuous mask support frame 20 in which the long sides 22, 24 lies in a common plane generally parallel to the mask 30. The apertured mask 30 shown here diagrammatically as a sheet for simplicity contains a plurality of elongated slits (not shown) that parallel the minor axis, Y, of the CRT 1. The mask 30 is preferably supported by and fastened to the frame 20.

The mask frame assembly 10 is fixed within the faceplate panel 3 by a plurality of studs 16 which are affixed in the corners formed along the inside surface of the peripheral sidewalls 9. As best shown in FIG. 2, the studs 16 are fastened to springs 18 which are attached at the corners of the frame 20 on angular sections between each long and short side 22, 24, 26, 28. In FIG. 2, the studs 16 are shown without the faceplate panel 3, although these studs 16 are shown only connected to the springs 18, it should be understood that one end of each stud 16 is affixed into a corner of the faceplate panel 3 as described above while the opposite end is secured to the spring 18.

An additional stud 35 is provided which is similarly affixed in the faceplate panel 3 in a sidewall 9 thereof along each of the long sides 22, 24. It should be understood that in FIG. 2 while only a single additional stud 35 is shown, a similar additional stud 35 may be engaged along the other long side 24. Each additional stud 35 is engaged by a bracket 36 at an opening 38 formed therein.

The bracket 36 will now be described in greater detail with reference to FIG. 3. A single bracket 36 will be described with the understanding that similar brackets 36 may be located on the opposite long side 24 and optionally along other locations on the frame 20. The bracket 36 is formed of a rigid material, preferably steel, which is formed or assembled into a generally C shape cross-section consisting of three walls. A mounting wall 40 extends generally parallel to a stud receiving wall 44. The mounting wall 40 and stud receiving wall 44 are joined by a connecting wall 42. An opening 38 is formed in the connecting wall 42 and extends into the stud receiving wall 44. As best shown in FIG. 3, this opening 38 passes only partially through each of the stud receiving wall 44 and the connecting wall 42. The opening 38 is dimensioned to be slightly larger than the diameter of the additional stud 35 to be received therein.

Figure 4:
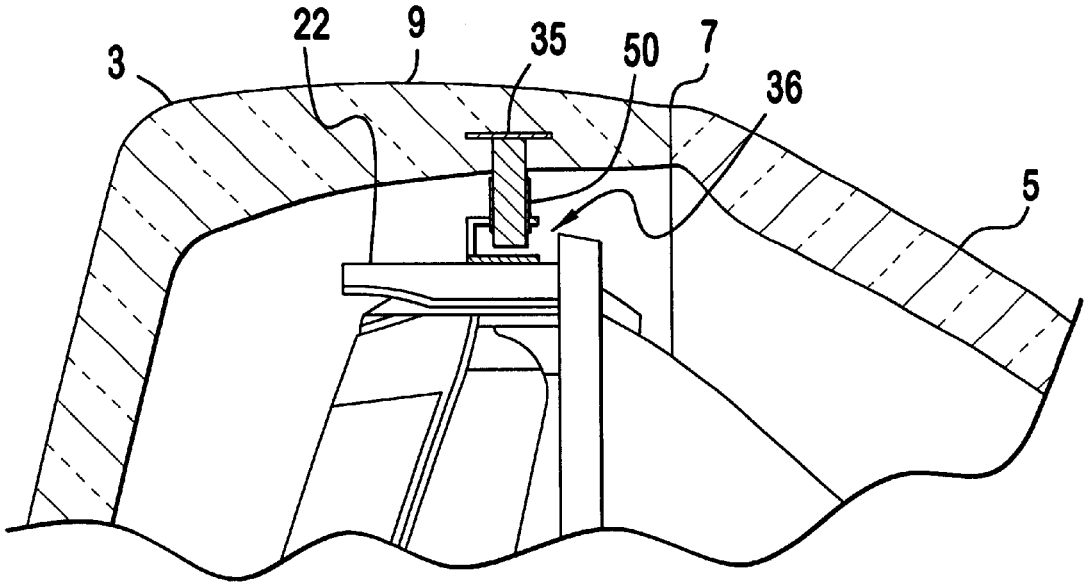
FIG. 4 is a sectional side view showing the stud affixed in a peripheral sidewall of the faceplate panel and attached to the mask frame assembly as shown in FIG. 2.

As best shown in FIGS. 3 and 4, a shim 50 is positioned around the additional stud 35 and both the stud and the shim fit within the opening 38. The shim 50 may be secured to the stud 35 by crimping, crushing or by spring fit and is designed to be more compliant than the additional stud 35. The shim 50 may take a variety of shapes or forms so as to remain more compliant than the additional stud 35. Each shim 50 may also be designed to be plastically or elastically deformed during an impact or may be formed from materials such as cold rolled steel to be relatively softer than the studs which can be formed of hardened steel, for example. Also, the addition of the shim reduces the space between the stud and bracket, which reduces the overall motion of the mask-frame assembly during a shock event. Finally, the shim prevents binding of the bracket and stud during a shock event because the shim's smooth surface and distribution of the bracket-to-stud contact force reduces friction.

Figure 5:
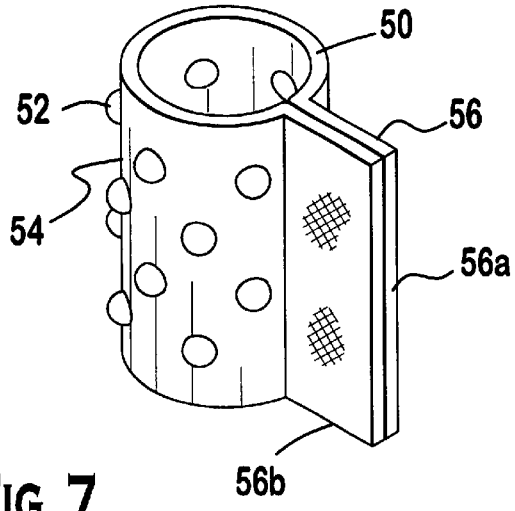
FIG. 5 is a perspective view of a first embodiment of the stud shim according to the present invention.

FIG. 5 shows a first embodiment of a shim 50. This shim 50 is generally cylindrical having a pair of open ends and plurality of protrusions 52 formed along its outer surface 54. These protrusions 52 are drawn from the outer surface 54 and are thinner and more compliant than the outer surface 54. A planar section 56 extends outward from the outer surface 54 and consists of a pair of plates 56a and 56b which engage each other.

Figure 6:
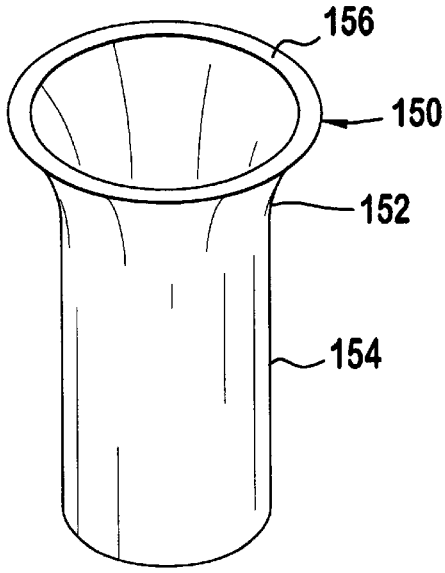
FIG. 6 is a perspective view of a first alternate stud shim.

FIG. 6 shows a first alternate embodiment of the shim 150 which is similar to the shim 50 except that a generally smooth cylindrical outer surface 154 is formed without the planar section shown in FIG. 5 and has a flared section 152 near an open end 156.

Figure 7:
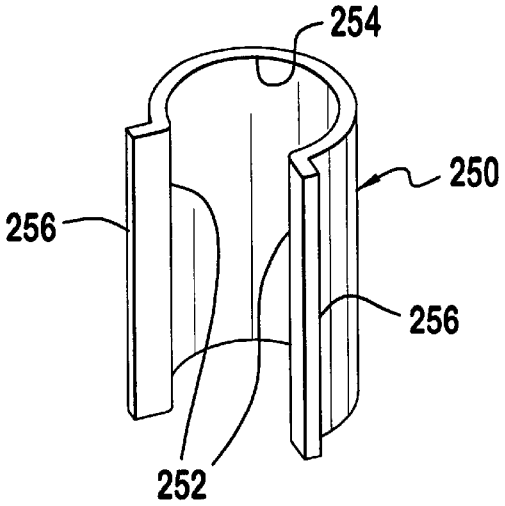
FIG. 7 is a perspective view of a second alternate stud shim.

FIG. 7 shows a second alternate embodiment of the shim 250, which is formed as a semi-cylindrical component having a pair of retaining sections 252 formed along an inner surface 254. A pair of bent sections 256 each extends outward from a respective retaining section 252.

Figure 8:
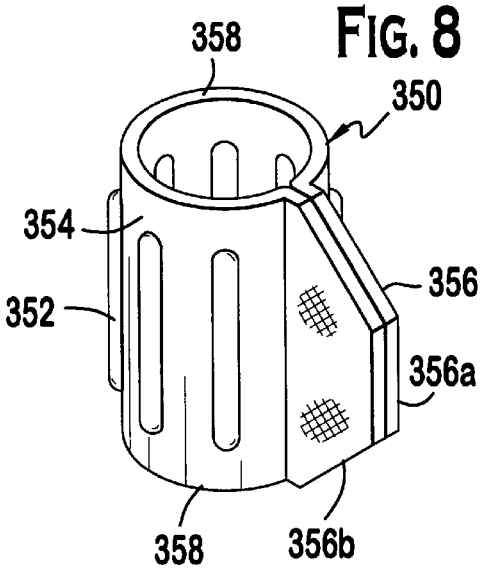
FIG. 8 is a perspective view of a third alternate stud shim.

FIG. 8 shows a third alternate embodiment of the shim 350. This shim 350 is a generally cylindrically shaped and has a plurality of long protrusions 352 formed along an outer surface 354. These long protrusions 352 extend substantially between the open ends 358 and are drawn outward similarly to the protrusion 52 shown in FIG. 5. Also, similar to the embodiment of FIG. 5, a planar section 356 extends outward from the outer surface 354 and consists two plates 356*a* and 356*b* being in engagement with each other. This planar section 356 also includes angled edges.

Figure 9:
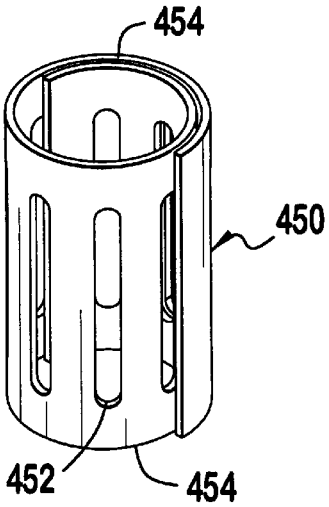
FIG. 9 is a perspective view of a fourth alternate stud shim.

FIG. 9 shows yet a fourth alternate embodiment of the shim 450. This shim 450 consists of a planar material, which has been rolled over itself to form a generally cylindrical shape having a pair of open ends 454. A plurality of openings 452 are formed in the material and extend substantially between the open ends 454.

In assembly, the studs 16 and additional studs 35 are first affixed into the faceplate panel 3 as is well known in the art. A shim is applied to each additional stud 35. Brackets 36 and springs 18 are applied to the frame 20 and the mask frame assembly 10 is then fastened to the studs 16 and additional studs 35. The studs 16 are tightly secured to the springs 18 by the spring's compressive forces while the additional studs 35 are not tightly secured to the bracket 36 but instead reside loosely in the openings 38.

Advantageously, upon impact, the additional studs 35 do not have a direct impact with the respective bracket 36. Instead, the shim 50 contacts the bracket 36 and the shim 50 undergoes a less rigid or softer impact due to the deformation of the shim 50 upon impact. The various surface features of each embodiment serve to make the shim deform either plastically or elastically upon contacting the bracket 36. This serves to reduce impact energy transferred to the frame 20 and mask 30.

What is claimed is:

1. A CRT having a funnel sealed at one end to a generally rectangular faceplate panel with two long sides and two short sides and forming an evacuated glass envelope, the panel including a luminescent screen on an interior surface thereof a mask assembly supported within the CRT near the screen, the faceplate panel having a peripheral sidewalls with an inside surface and four corners including a plurality of studs affixed to the inside surface, a plurality of springs positioned on the mask assembly that engage the plurality of studs to support the mask assembly within the CRT, the CRT comprising at least one additional stud affixed along the inside surface of one of the sidewalls, a shim attached and surrounding the additional stud, and at least one bracket positioned on the mask frame and having a slot into which the shim is loosely engaged at a location remote from the springs.

2. The CRT as recited in claim 1 wherein at least one of the plurality of studs is affixed to a corner of the faceplate panel.

3. The CRT as recited in claim 1 wherein the at least one additional stud is affixed to the sidewall at a long side of the faceplate panel.

4. The CRT as recited in claim 1 wherein the shim is attached around the additional stud by crimping.

5. The CRT as recited in claim 1 wherein the shim is attached around the additional stud by crushing.

6. The CRT as recited in claim 1 wherein the shim is attached around the additional stud by spring fit.

7. The CRT as recited in claim 6 wherein the shim further comprises a planar section extending outward from an outer surface thereof.

8. The CRT as recited in claim 6 wherein an outer surface of the shim further comprises protrusions drawn outward from the outer surface.

9. The CRT as recited in claim 1 wherein the shim is generally cylindrically shaped and formed to remain more compliant than the additional stud.

10. The CRT as recited in claim 9 wherein the shim further comprises a flared section near an open end of the generally cylindrically shaped shim.

11. The CRT as recited in claim 10 wherein the shim is formed by rolling a flat piece of material over itself and includes a plurality of openings extending substantially between the open ends of the cylindrically shaped shim.

12. The CRT as recited in claim 1 wherein the shim comprises a generally semi-cylindrical component having a pair of retaining sections formed along an inner surface thereof.

* * * * *